US006491110B2

(12) United States Patent
Gil

(10) Patent No.: US 6,491,110 B2
(45) Date of Patent: Dec. 10, 2002

(54) THERMAL AMPOULE FOR SPRINKLER

(76) Inventor: Jong Jin Gil, 1-101 Kumgang Apt., 16-19, Sosa-dong, Wonmi-ku, Boochun-city, Kyoungki-do 420-050 (KR)

( * ) Notice: Subject to any disclaimer, the term of this patent is extended or adjusted under 35 U.S.C. 154(b) by 0 days.

(21) Appl. No.: 10/034,319

(22) Filed: Dec. 21, 2001

(65) Prior Publication Data

US 2002/0053440 A1 May 9, 2002

Related U.S. Application Data

(63) Continuation of application No. PCT/KR00/00545, filed on May 26, 2000.

(30) Foreign Application Priority Data

May 2, 2000 (KR) ..... 00-23442

(51) Int. Cl.[7] ..... A62C 2/00; A62C 37/08

(52) U.S. Cl. ..... 169/43; 169/42; 169/61; 169/DIG. 3; 169/37; 239/75; 340/590

(58) Field of Search ..... 169/37, 42, 43, 169/54, 56, 57, 60, 61, DIG. 3; 239/75; 340/577, 584, 590, 592

(56) References Cited

U.S. PATENT DOCUMENTS 2,245,144 A 6/1941 Griffith
3,884,304 A * 5/1975 Messerschmidt et al. ..... 169/42
5,513,708 A * 5/1996 Sundholm ..... 169/37
5,622,225 A * 4/1997 Sundholm ..... 169/61
6,347,669 B1 * 2/2002 Sundholm ..... 169/37

FOREIGN PATENT DOCUMENTS

WO WO 93/21998 11/1993

* cited by examiner

*Primary Examiner*—Steven J. Ganey

(57) ABSTRACT

An electrical thermal glass ampoule for fire fighting sprinkler is disclosed. The ampoule(200) according to the present invention comprises a closed hollow cylindrical glass casing (100), an electrically heating coil(120) installed inside of said glass casing, a negative electrode(140) provided on outer surface at bottom end of said casing and electrically connected with one end of said coil, a positive electrode (142) provided on outer surface at side wall of said casing and electrically connected with the other end of said coil, and heat expansive gas(G) entrapped inside the casing. The glass ampoule(200) can be precisely manufactured as a single body integrated with a thermal coil(120) inside of the casing, have good install handiness due to no necessity of coil being wound around the ampoule and has long term duration because the coil(120) is installed inside the glass casing(100) and, thus can be prevented from corrosion. Further, the glass ampoule(200) according to the present invention has another advantage of much faster actuating response because the coil(120) is heated inside the glass casing and, thus, can give heat directly to the gas(G).

21 Claims, 22 Drawing Sheets

Prior Art

Prior Art

Prior Art

Prior Art

Prior Art

Prior Art

Prior Art t1 = synchronous information
t2 = first information interval
t3 = second information interval
p1 < p2

THERMAL AMPOULE FOR SPRINKLER

RELATED APPLICATION

This application is a continuation application of PCT application No. PCT/KR00/00545 filed on May 26, 2000 and published on Nov. 8, 2001 in English, which is hereby incorporated by reference herein.

TECHNICAL FIELD

The present invention relates to an electric thermal ampoule for a sprinkler.

DESCRIPTION OF THE RELATED TECHNOLOGY

Generally, sprinklers are fire fighting equipment installed on the ceilings of buildings for spraying extinguishing liquid, or water, upon sensing the occurrence of a fire, so as to extinguish the fire.

A typical sprinkler head H comprises, as shown in FIG. 1, an extinguishing liquid discharging nozzle 1 coupled with an extinguishing liquid supply pipe 33 via a pipe coupling socket 23, an O-ring-shaped body 2 extending downwardly out of the outer surface of the discharging nozzle 1, an extinguishing liquid diffusing plate 6 fitted horizontally under and to the lower end of the O-ring-shaped body 2, a valve plate 3 for normally holding the discharging nozzle 1 closed, a trigger 4 installed within a space between the valve plate 3 and the bottom of the body 2 for supporting the valve plate 3, and a thermal fuse 7 installed within the trigger 4. The thermal fuse F includes, as shown in FIG. 2, a hollow drum-shaped casing 11 enclosed at its bottom, low-temperature fusing lead 13 filled within the casing 11 and held solid at room temperature, and an actuating pin 12 held within the lead 13 at its lower end and projected out of the top of the casing 11 at its upper end. As the ambient temperature rises due to the occurrence of a fire, the low-temperature fusing lead 13 in the thermal fuse 7 fuses to become a liquid state, thereby causing the actuating pin 12 to be sunk in the lead 13 and thus the valve plate supporting balance of the trigger 4 to be broken. As a result, the valve plate 3 opens the extinguishing liquid discharging nozzle 1 to spray extinguishing liquid.

There has been proposed another conventional sprinkler wherein a glass ampoule (not shown) filled with a temperature-expansive gas(G) is provided instead of the above low-temperature fusing lead-type thermal fuse as shown in FIG. 3. If a fire occurs, then the gas in the glass ampoule expands to break the glass ampoule, thereby causing a valve plate supporting force to be lost. This sprinkler is substantially the same in operation as that with the low-temperature lead thermal fuse.

On the other hand, the above-mentioned conventional sprinklers using either the low-temperature lead fuse or temperature-expansive glass ampoule have such a structure that the fuse or glass ampoule reacts directly to substantial heat of a fire. In this regard, such conventional sprinklers are disadvantageous in that they have a very slow response to the initial stage of a fire because they are not actuated in the event of the fire until the ambient temperature reaches a fusing point of the low-temperature lead or an expansion-breaking point of the glass ampoule. In connection with such a problem, U.S. Pat. No. 2,245,144, invented by William B. Griffith, et al., shows a technique for breaking or melting the glass ampoule or low-temperature lead fuse using not the fire heat but electric heating means. In this U.S. patent, as shown in FIG. 4, in the event of a fire, a diaphragm (41 in the patent) first expands at a low temperature prior to the melting of the fuse and then applies electric power to an electric heating coil (20 in the patent) around the fuse or glass ampoule. In this technique, the diaphragm functions as a mechanical temperature sensor expanding when the ambient temperature exceeds a predetermined threshold value and also as an electrical switch for applying electric power to electric heating means(electric heating coil) upon the expansion.

Another approach to using the electric heating means around the fuse or glass ampoule is shown in International Application No. PCT/FI93/00164 (International Publication No. WO 93/21998), inverted by Sundholm, Gbran. In this publication, as shown in FIGS. 5*a,* 5*b* and 5*c,* an electric heating coil(8 in the publication) of memory metal is laid around the glass ampoule. The memory metal coil is held contracted at room temperature to hold an electric circuit opened (see FIG. 5*a*). When the ambient temperature reaches a predetermined threshold value due to the occurrence of a fire, the memory metal coil changes(or expands) its shape to function as a switch for closing the electric circuit. After closing the electric circuit, the memory metal coil functions as the electric heating means for heating the fuse or ampoule. For reference, FIG. 5*b* shows a state where the memory metal coil expands and makes an electrical connection to act as a heater, and FIG. 5*c* shows a state where a spindle (5 in the publication) is pressed downwardly (to spray extinguishing liquid) under the influence of a spring (6 in the publication) after the glass ampoule is broken.

The sprinklers shown in the '144 patent and '21998 publication comprise the electric heating means for heating the fuse or glass ampoule at a predetermined low temperature before the substantial fire heat reaches the fuse or glass ampoule. In this regard, such sprinklers are advantageous in that they have a faster response to the initial stage of a fire than that of the conventional sprinklers using the glass ampoule or fuse breaking or melting due to the direct heating by the substantial fire heat. However, such sprinklers still have the following disadvantages.

Firstly, because fire-fighting equipment, such as sprinklers, is installed and not used until the occurrence of a fire, it is unused for a lengthy period of time due to the fact that there is no fire. As a result, the fire fighting equipment may be aged or have partially damaged electric circuitry due to a lack of maintenance, finally becoming inoperable in the actual event of a fire. In order to solve this problem, there is a need to frequently test the normal operations of the sprinklers. However, it is not easy to frequently test a large number of sprinklers installed on the ceiling.

Secondly, in almost all cases, a fire starts in a localized area, and only a sprinkler installed in that local area is actuated. Sprinklers installed in other adjacent rooms are not actuated, thereby making it impossible to prevent the fire from spreading to the adjacent rooms. On the other hand, in the previously stated '144 patent, another switching means (37 in the patent) is provided in addition to the diaphragm-type mechanical/ electrical switching means to manually close the electric circuit. The provision of such other switching means may establish manual electrical connections to sprinklers in other places than the place where a fire stars, as needed. However, this '144 patent does not show any means (for example, means for connection between sprinklers, means for acquiring information needed for an operator's operation, command transfer means, etc.) embodied for controlling individual electrical connections to the respective sprinklers.

In consideration of the forgoing problems in conventional sprinklers, the present inventor suggested in Korean patent application No. 2000-8114 (corresponding PCT/KR00/00186) filed on Feb. 21, 2000, as shown in FIGS. 6 to 10, a sprinkler apparatus comprising a heater 14 operable by temperature sensing means, a thermal fuse 13 melting by heat from said heater, and a valve plate 3 for opening an extinguishing liquid discharging nozzle of a sprinkler head in response to the melting of said thermal fuse to discharge extinguishing liquid, wherein said sprinkler apparatus further comprises a sprinkler head controller C including a transmitter and a receiver, said sprinkler head controller performing a self-diagnostic operation according to an algorithm contained therein in such a manner that it supplies a small amount of current to said heater and detects the amount of current flowing through said heater and externally transmitting the self-diagnostic result and a temperature value sensed by said temperature sensing means; and a main computer MC installed in a central control station for informing an operator of said self-diagnostic result and temperature value transmitted from said sprinkler head controller.

The present invention relates to a glass ampoule filled with a temperature-expansive gas for sprinklers instead of the low-temperature melting lead type thermal fuse which is described in the Korean patent application No. 2000-8114.

In the conventional electric heating glass ampoule for sprinklers, as shown in '21998 publication, an electric thermal coil is provided around the ampoule. In this type of sprinkler, it is necessary to coat the outer surface of the coil so as to prevent corrosion. Furthermore, if it happens to break in the power supply circuit and, thus, no electric power is supplied to the coil, the coil has a harmful effect on the ampoule. This is because it blocks heat transfer and, therefore, the actuating response of the ampoule deteriorates. Moreover, since the size of the ampoule is very small, it is not easy to wind the coil around it. In addition, if the coil is not tightly wound around the ampoule and, thus, there is a gap between the coil and the outer surface of the ampoule, the actuating response of the ampoule deteriorates. Deterioration of the actuating response of the ampoule is also caused from the fact that the direction of heat transfer is from the outside of the ampoule to the inside. Finally, if the coil is manufactured using a thin wire in order to be actuated by low power, it is much more difficult to prevent corrosion.

SUMMARY OF CERTAIN INVENTIVE ASPECTS

Therefore, embodiments of the present invention can be made in view of the above problems in glass ampoule type, so as to increase efficiency of heat transfer, actuating response, duration and ease of intallation of the glass ampoule.

In accordance with one aspect of the present invention, an electrically breakable glass ampoule for a sprinkler apparatus comprises a closed hollow cylindrical glass casing, an electrical heating coil installed inside of the glass casing, a negative and a positive electrode are provided on the outer surface of the glass casing, each of the electrodes being electrically connected with both ends of the heating coil respectively and heat expansive gas filling the glass casing.

In accordance with another aspect of the present invention, a thermal ampoule for use in a sprinkler comprises a hollow casing containing a heat expansive gas, the gas having a characteristic rate of expansion given heat, the casing comprising first and second closed end portions located opposite to each other, and a side wall portion formed between the first and second closed end portions; and an electrical coil located in the inside of the casing and conducting an applied current flow therethrough, wherein the electrical coil generates a selected amount of heat in proportion to the current, and the heat is transferred to the gas. The hollow casing is configured to break as a result of the expansion of the gas. The coil includes first and second terminals, the first terminal being configured to receive the applied current, the second terminal being configured to cause the current to flow through the coil. The thermal ampoule further comprises first and second electrodes; and first and second electrical wires connecting the first and second terminals of the coil to the first and second electrodes, respectively; wherein the first electrode is configured to transfer the applied current to the first terminal, and the second electrode is connected to the ground. The first electrode and the connection to the first terminal are located on the outside of the casing, and the first electrical wire passes through the hollow casing in order to connect the first terminal to the first electrode. The side wall portion includes a protruding portion, and the first electrode is located on the protruding portion and shaped in conformance with the shape of the protruding portion. The second electrode is located on the second closed end portion, and the second electrical wire passes through the hollow casing in order to connect the second terminal to the second electrode. The first electrode is located on the first closed end portion, and the second electrode is located on the second closed end portion. The casing is formed from a substantially glass material. The casing has a substantially cylindrical shape.

In accordance with still another aspect of the present invention, a thermal ampoule for use in a sprinkler comprises a closed hollow casing enclosing a heat expansive gas, the gas being selected to expand according to a specific amount of applied heat; and an electrical coil located in the inside of the casing and conducting current therethrough, wherein the electrical coin generates first and second amounts of heat in proportion to first and second applied currents, respectively, and transfers the first and second amounts of heat to the gas. The first amount of heat is selected to allow the gas to expand and break the hollow casing. The second current is smaller than the first current, and the second amount of heat is selected so that the expanded gas does not break the hollow casing.

In accordance with another aspect of the present invention, a sprinkler head for use in a sprinkler comprises a housing defining a liquid supply hole, the hole adapted to supply an extinguishing liquid to the inside of the housing; a thermal ampoule located in the housing and containing a heat expansive gas and an electrical coil therein, the gas being selected to expand according to a selected amount of applied heat, wherein the coil is configured to generate the selected amount of applied heat based on an input current and is configured to transfer the selected amount of applied heat to the gas; a valve plate supported by the ampoule so as to keep the hole closed; wherein the amount of applied heat is selected to allow the expanded gas to break the ampoule, and the valve plate is configured to open the hole in response to the breaking of the ampoule, thereby discharging the extinguishing liquid from the sprinkler head.

In accordance with yet another aspect of the present invention, a method of operating a thermal ampoule for use in a sprinkler is provided. The method comprises applying a current to an electrical coil located in the inside of the thermal ampoule, the ampoule containing an expansion gas surrounding the coil; and feeding the current through the electrical coil so as to generate heat and expand the gas. The amount of generated heat is selected to allow the gas to expand and break the thermal ampoule. The applying comprises providing the current from a first electrode located on the outside of the ampoule to a first terminal of the coil. The feeding comprises feeding the current from the first terminal to a second terminal of the coil, the second terminal being electrically connected to a second electrode located on the outside of the ampoule. The ampoule is formed from a substantially glass material. The ampoule has a substantially cylindrical shape.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF CERTAIN INVENTIVE EMBODIMENTS

Figure 1:
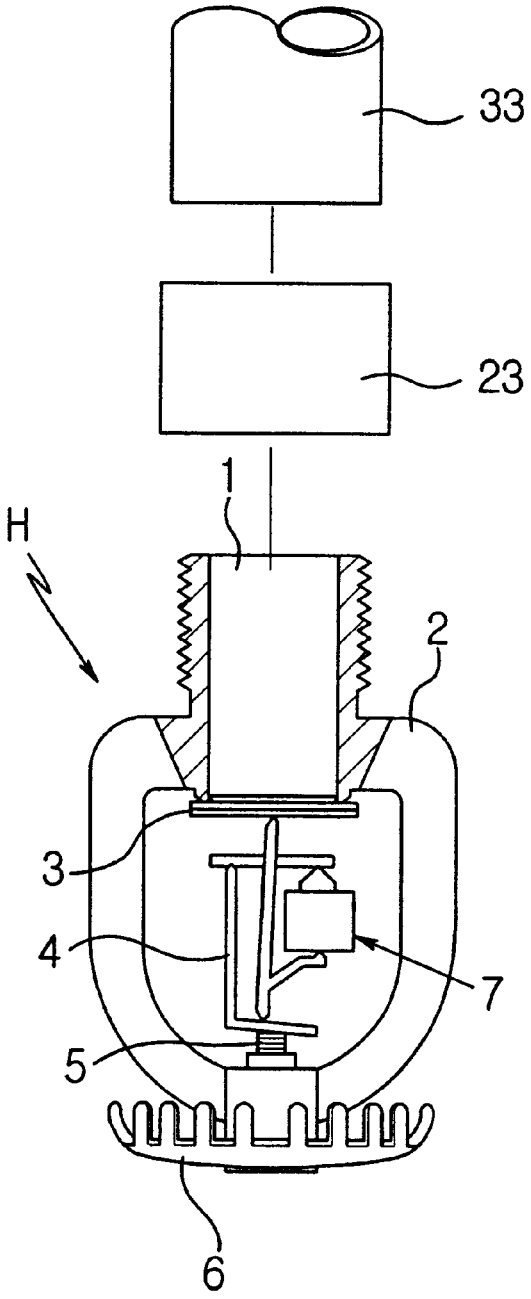
FIG. 1 is a sectional view of a conventional sprinkler head.
Figure 2:
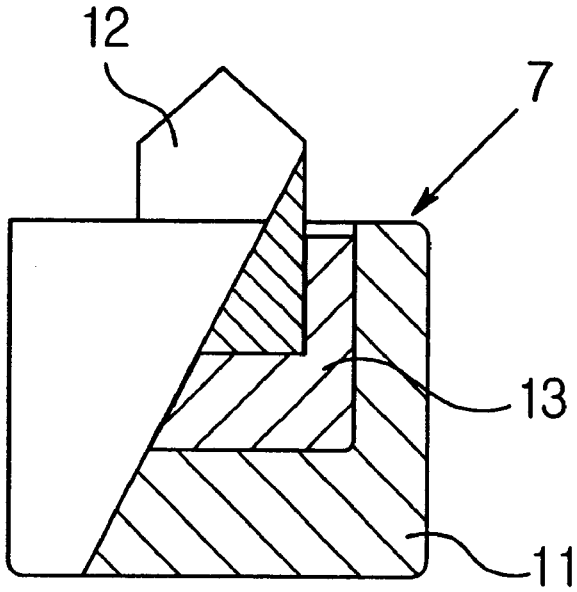
FIG. 2 is an enlarged, sectional view of a low-temperature fusing lead fuse in FIG. 1.
Figure 3:
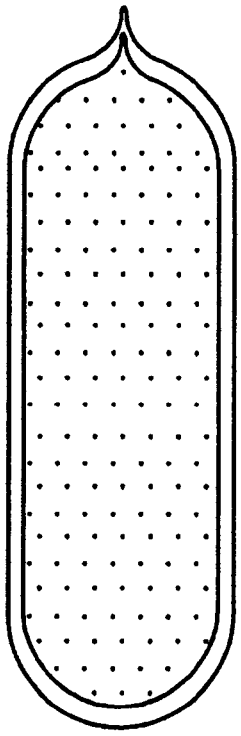
FIG. 3 is a sectional view of conventional glass ampoule for sprinkler.
Figure 4:
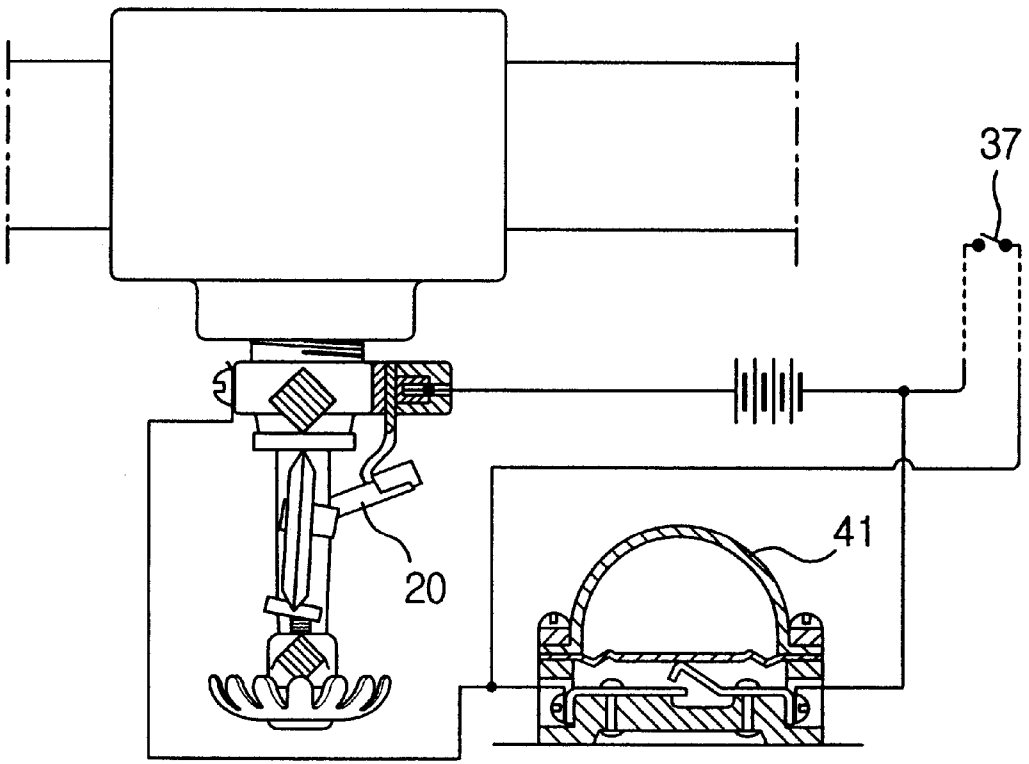
FIG. 4 shows an sprinkler described in the U.S. Pat. No. 2,245,144.
Figure 5A:
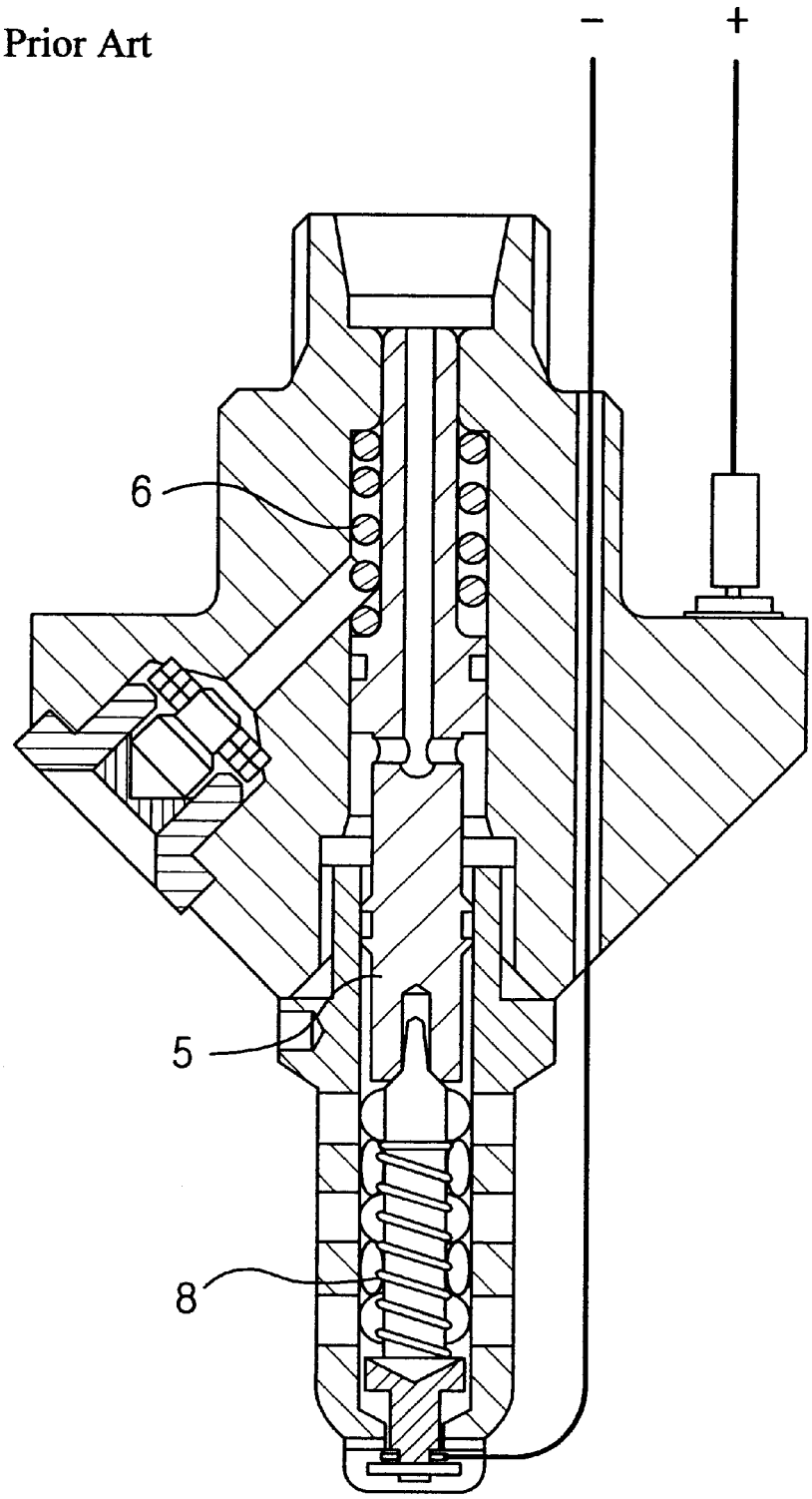
FIG. 5*a* is a sectional view illustrating a state of the sprinkler at normal room temperature described in WO 93/21998.
Figure 5B:
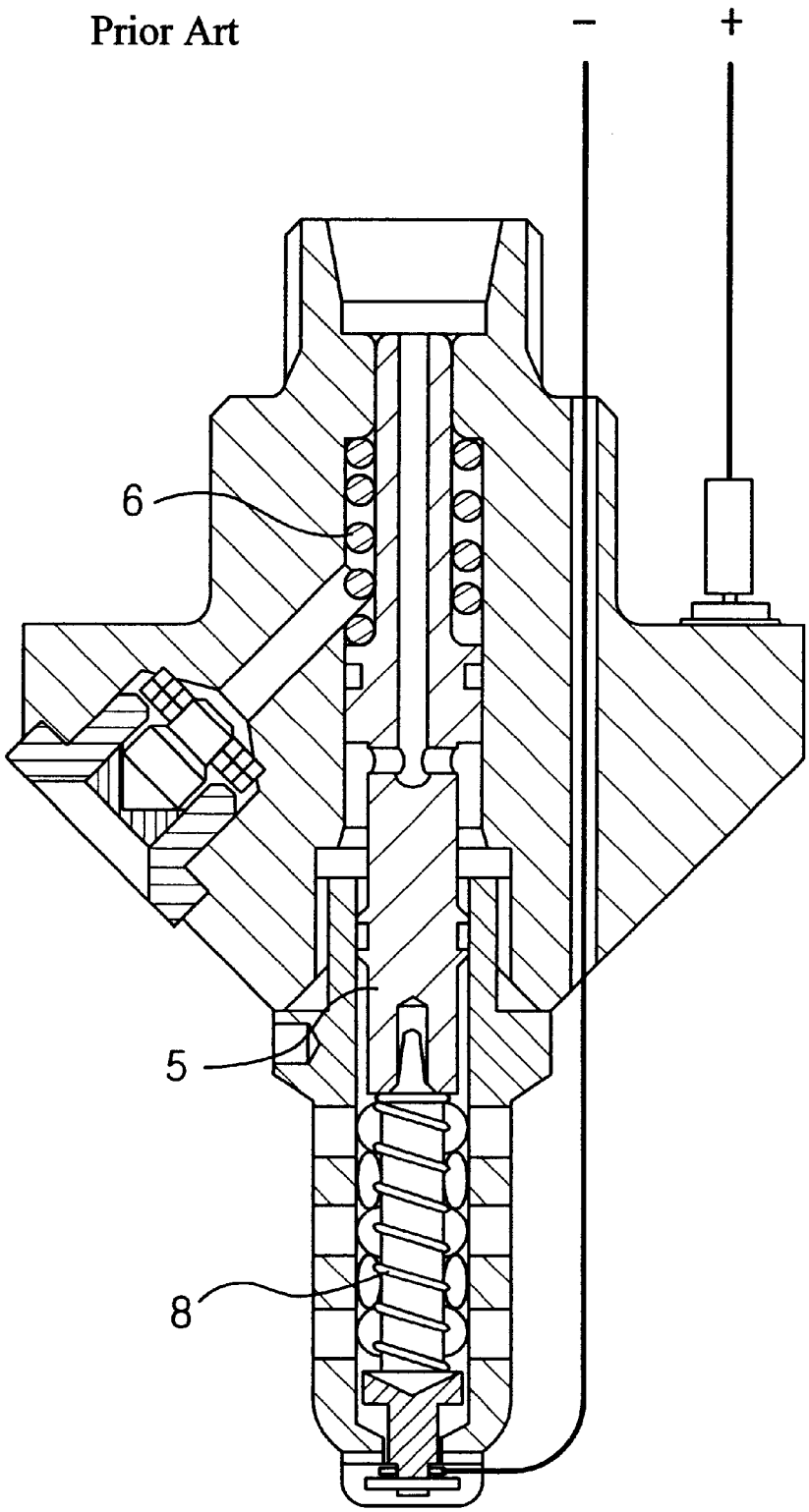
FIG. 5*b* is a sectional view illustrating an expanded state(an ampoule heating state)of the memory metal coil in WO 93/21998.
Figure 5C:
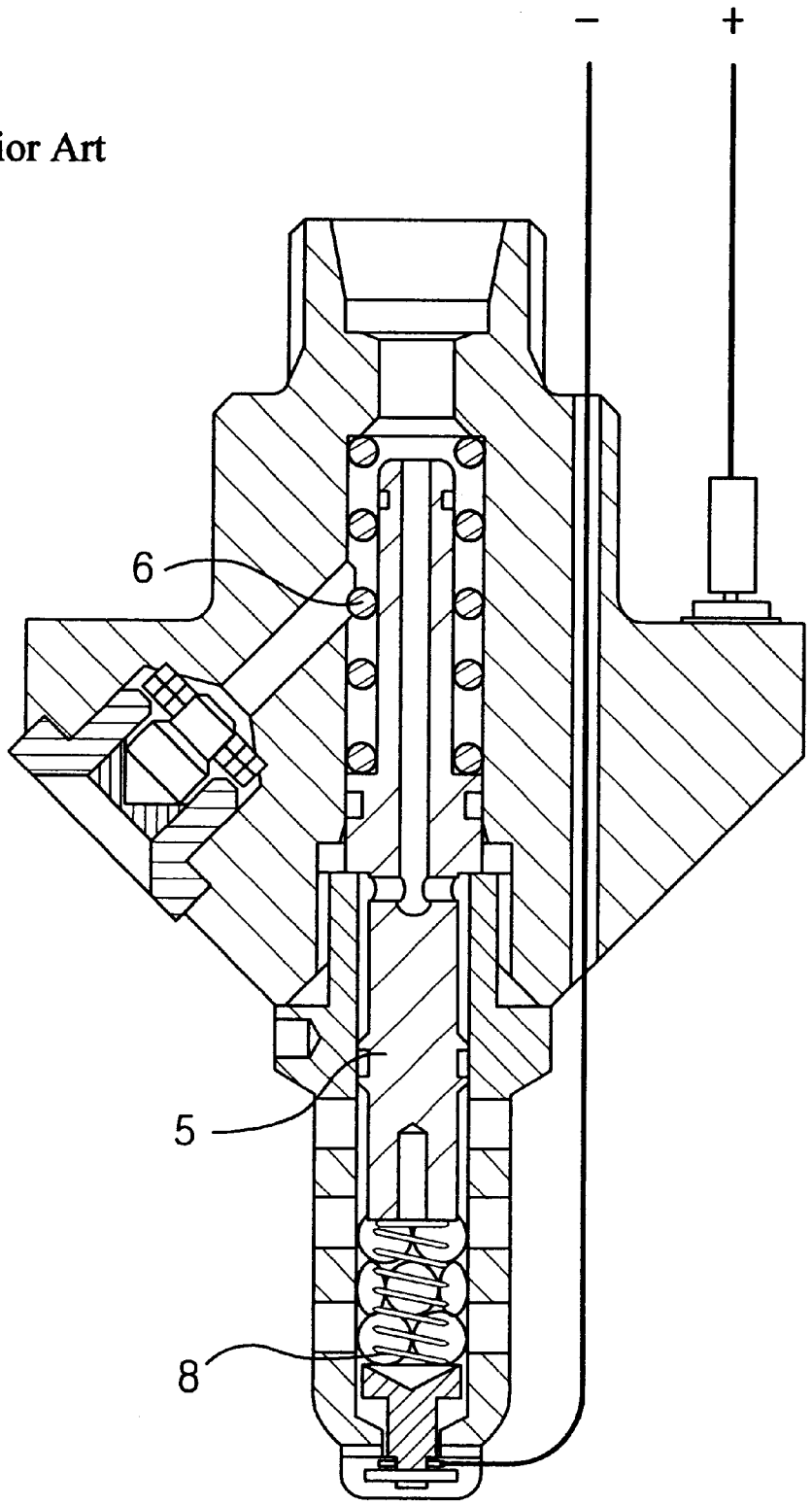
FIG. 5*c* is a sectional view illustrating a pressed state (an extinguishing liquid spraying state) of the spindle after the ampoule is broken in WO 93/21998.
Figure 6:
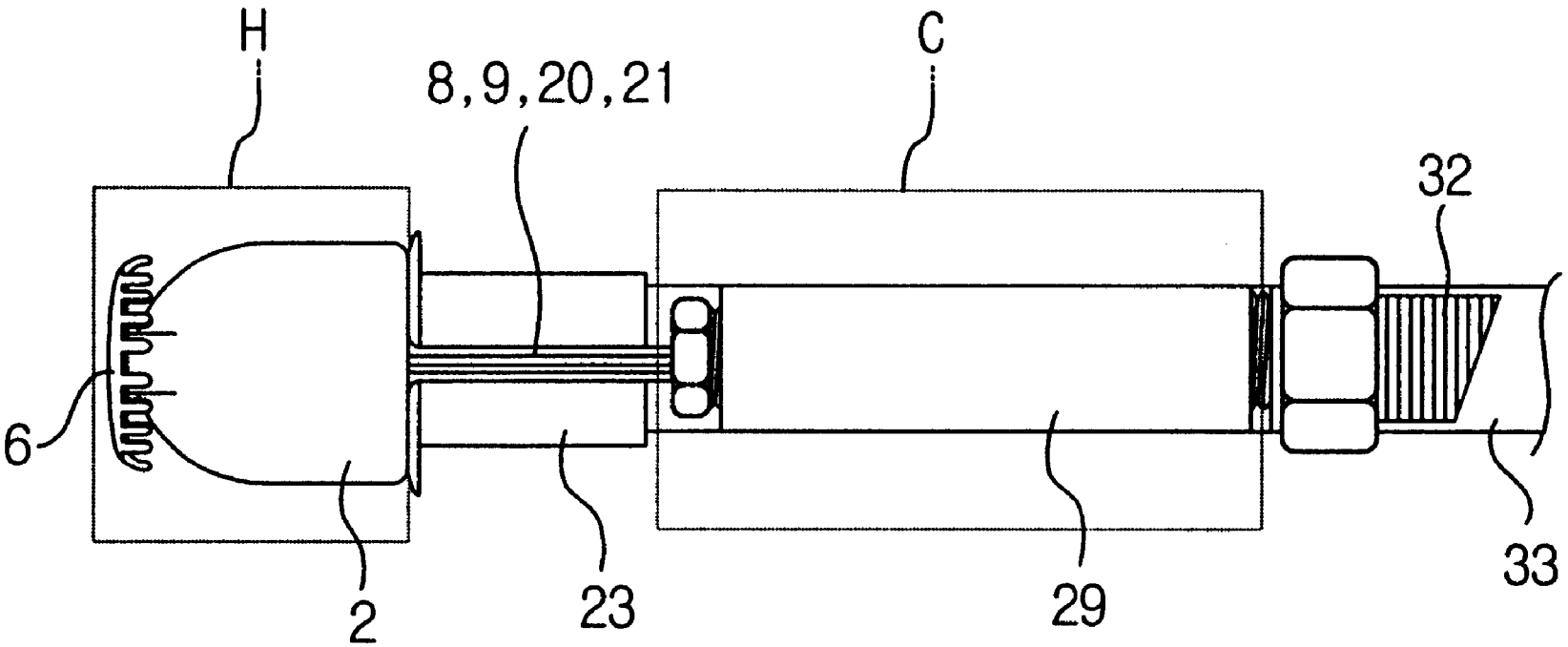
FIG. 6 is a schematic view of the sprinkler apparatus invented by the present inventor and disclosed in the Korean Patent application No. 2000-8114.
Figure 7:
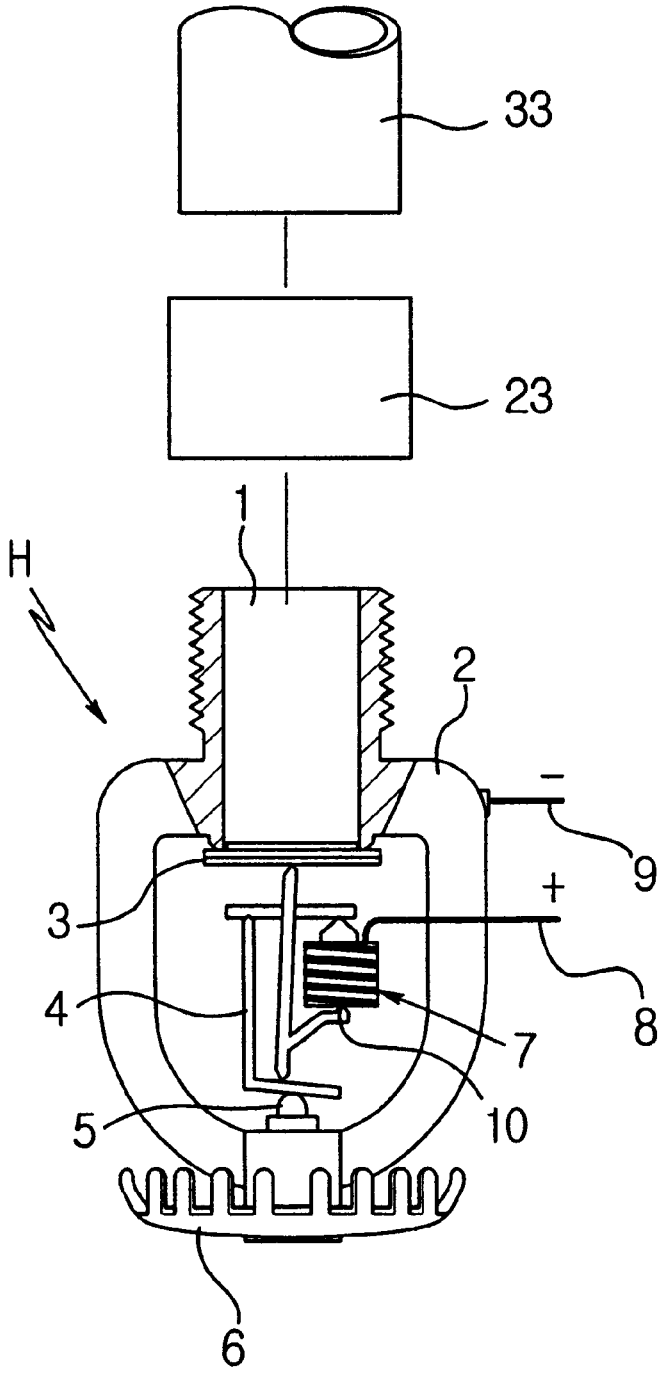
FIG. 7 is a sectional view of the sprinkler head shown in the Korean Patent application No. 2000-8114.
Figure 8:
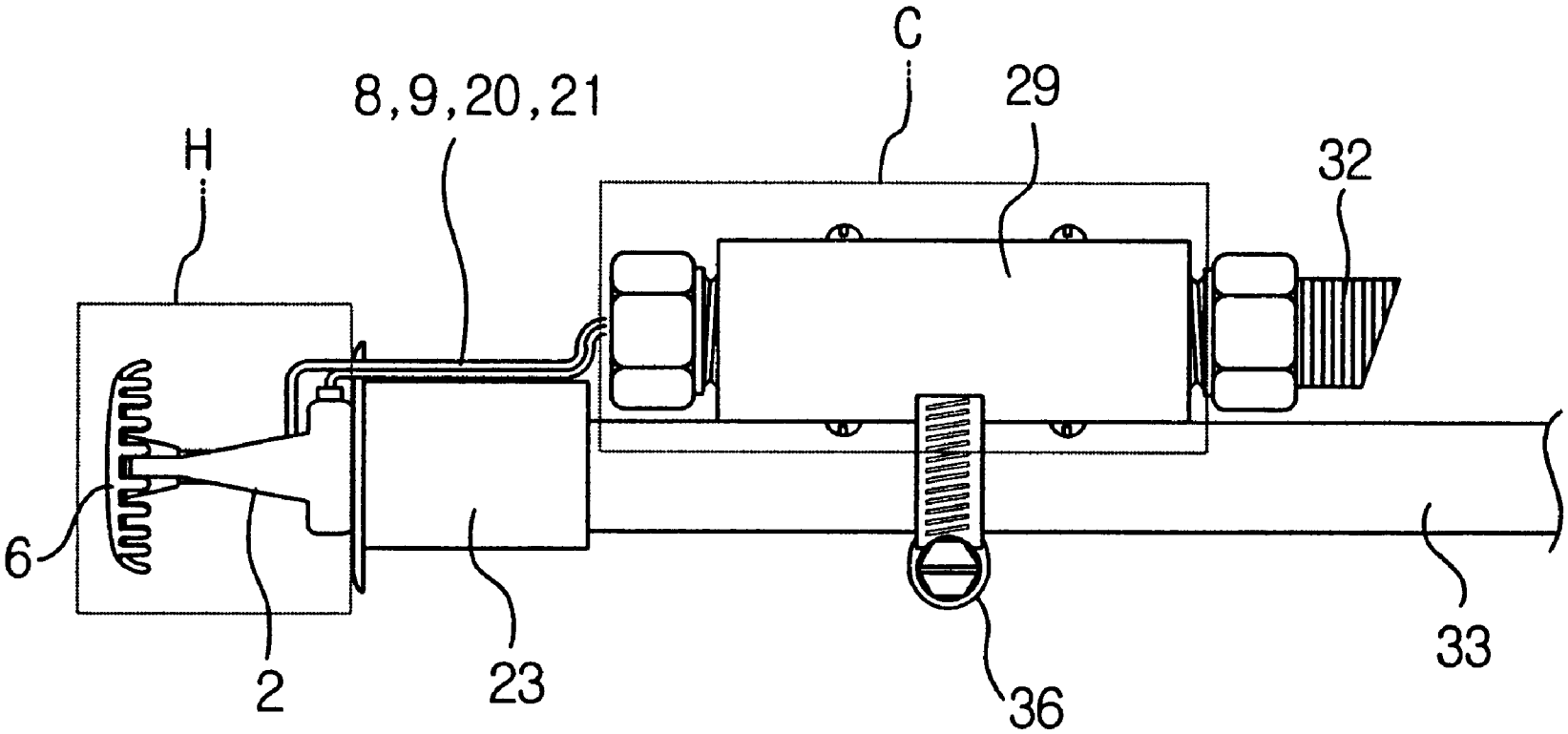
FIG. 8 is a side view of the sprinkler shown in the Korean Patent application No. 2000-8114.
Figure 9:
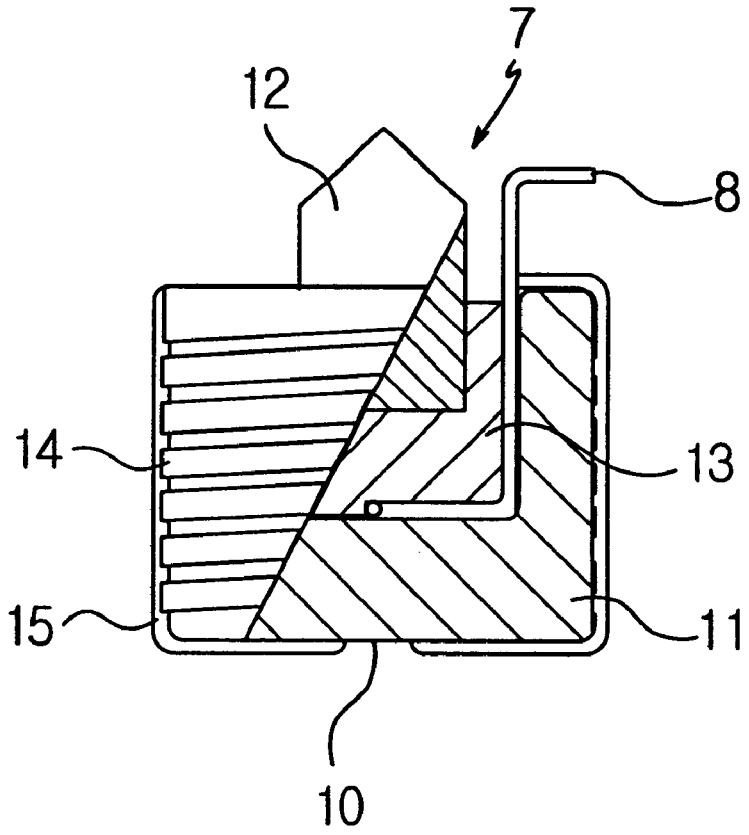
FIG. 9 is an enlarged, sectional view of a low-temperature fusing lead fuse in the Korean Patent application No. 2000-8114.
Figure 10:
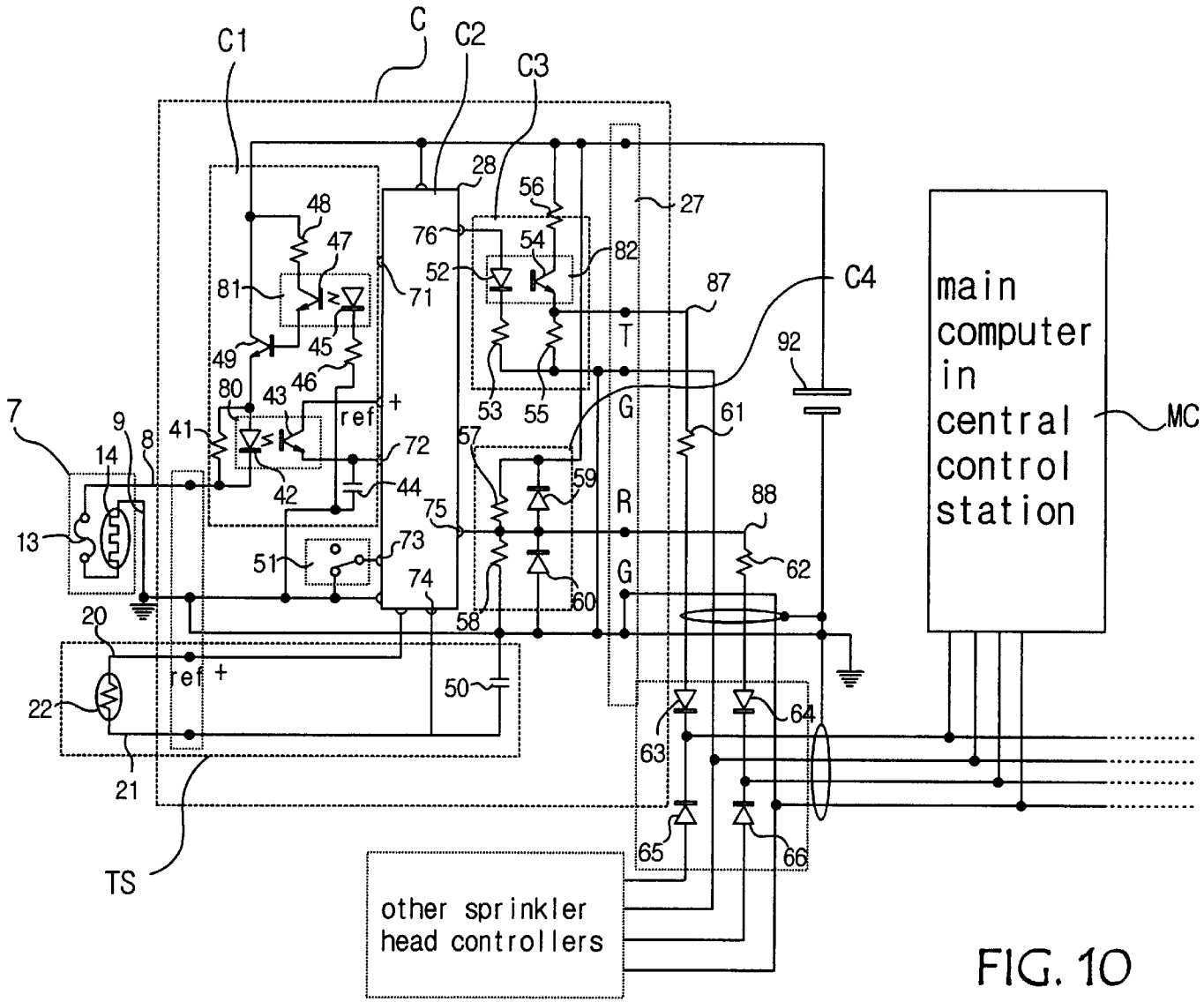
FIG. 10 is a circuit diagram of a sprinkler apparatus shown in the Korean Patent application No. 2000-8114.
Figure 11:
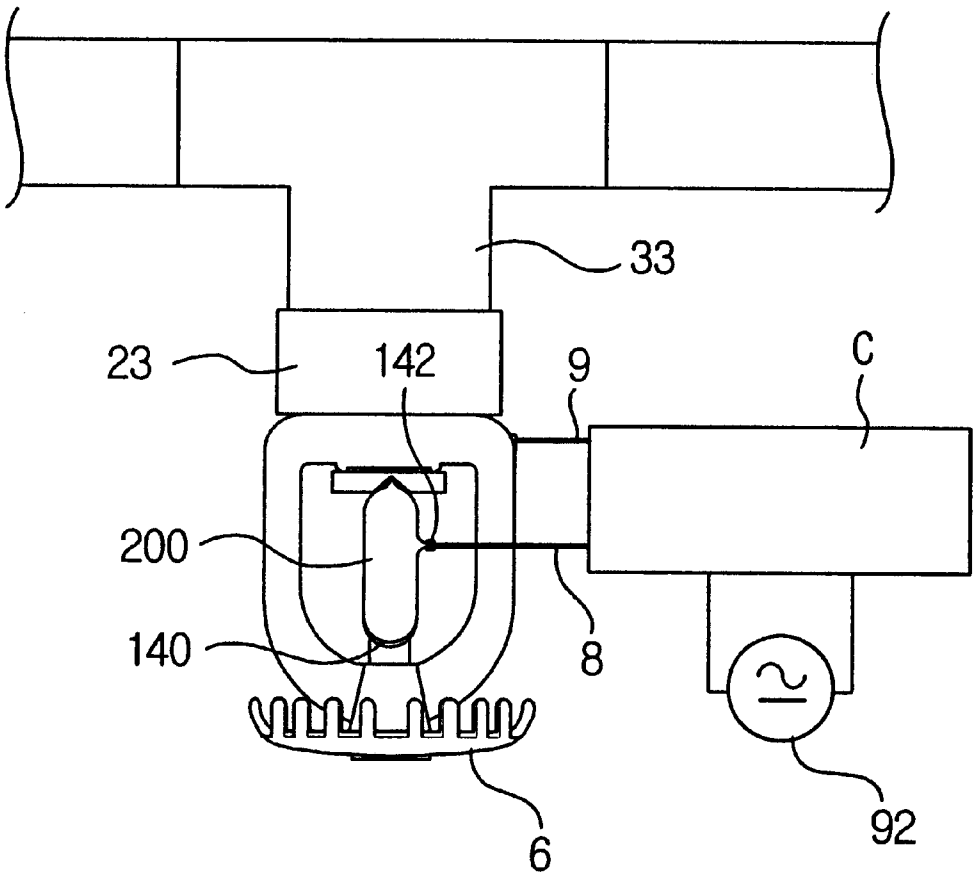
FIG. 11 is a schematic view showing a structure of a sprinkler apparatus in accordance with the preferred embodiment of the present invention.
Figure 12:
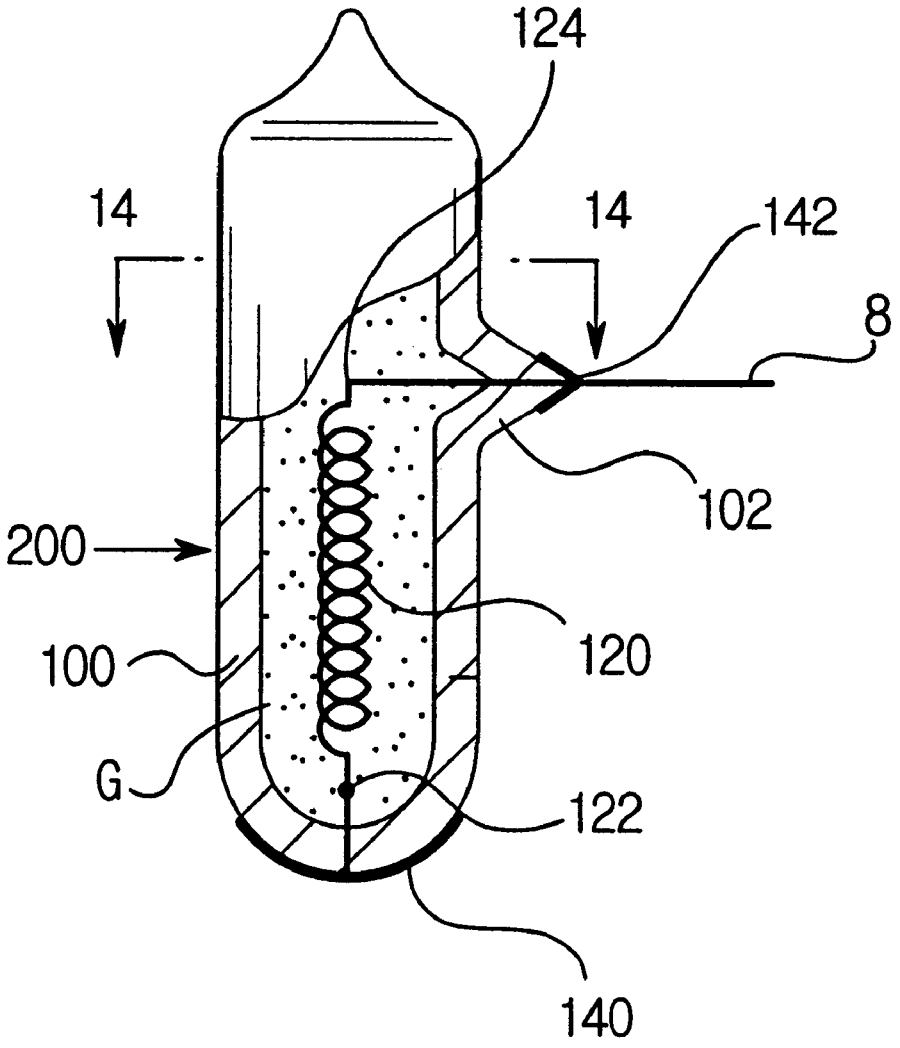
FIG. 12 is an enlarged, sectional view of the thermal glass ampoule according to the present invention.
Figure 13:
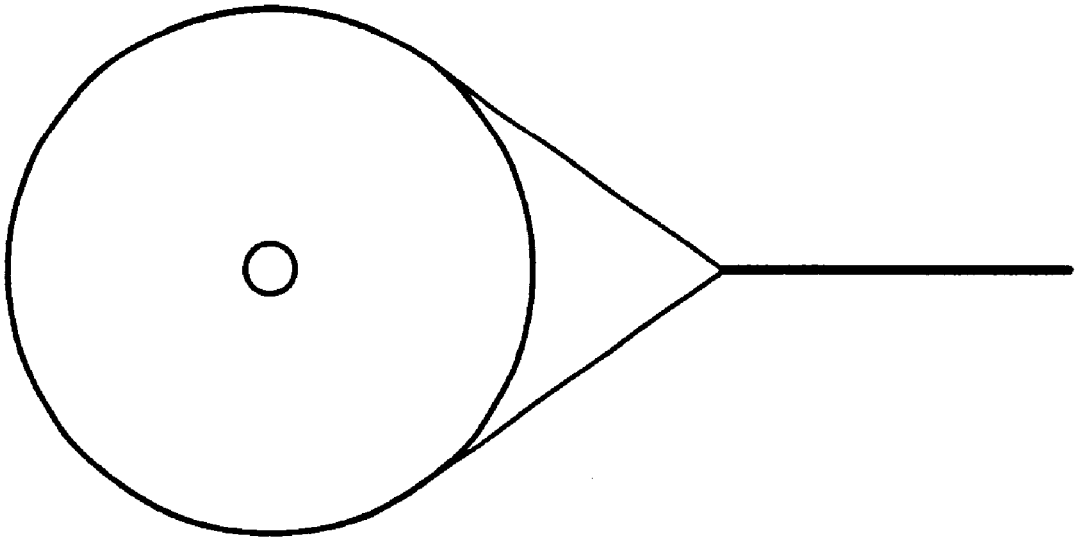
FIG. 13 is a plan view of the thermal glass ampoule according to the present invention.
Figure 14:
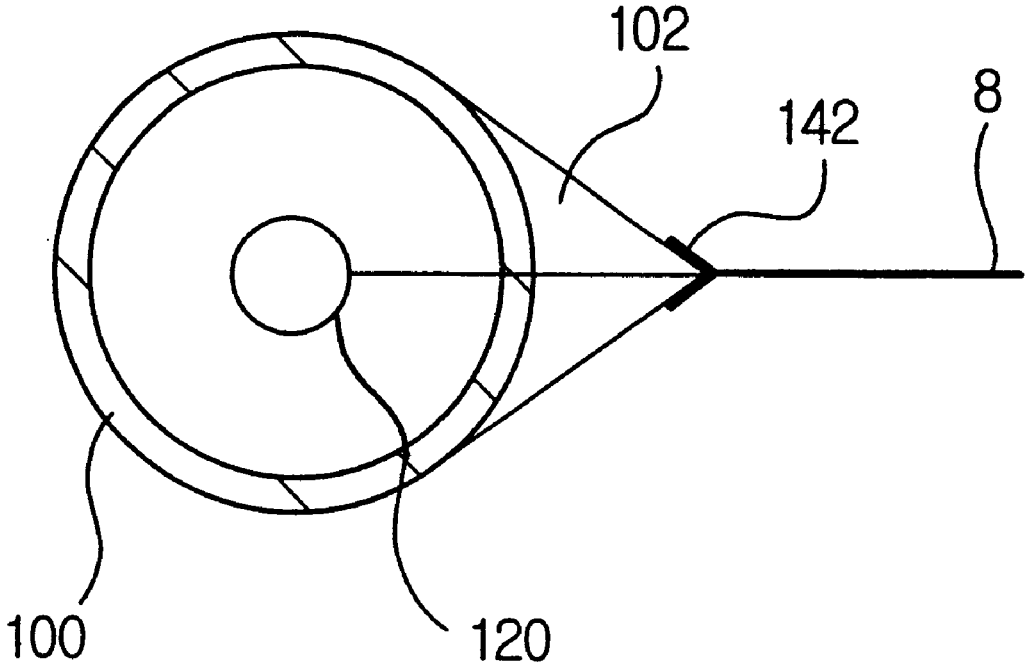
FIG. 14 is a sectional view of the thermal glass ampoule according to the present invention taken along the line 14—14 in FIG. 12.
Figure 15:
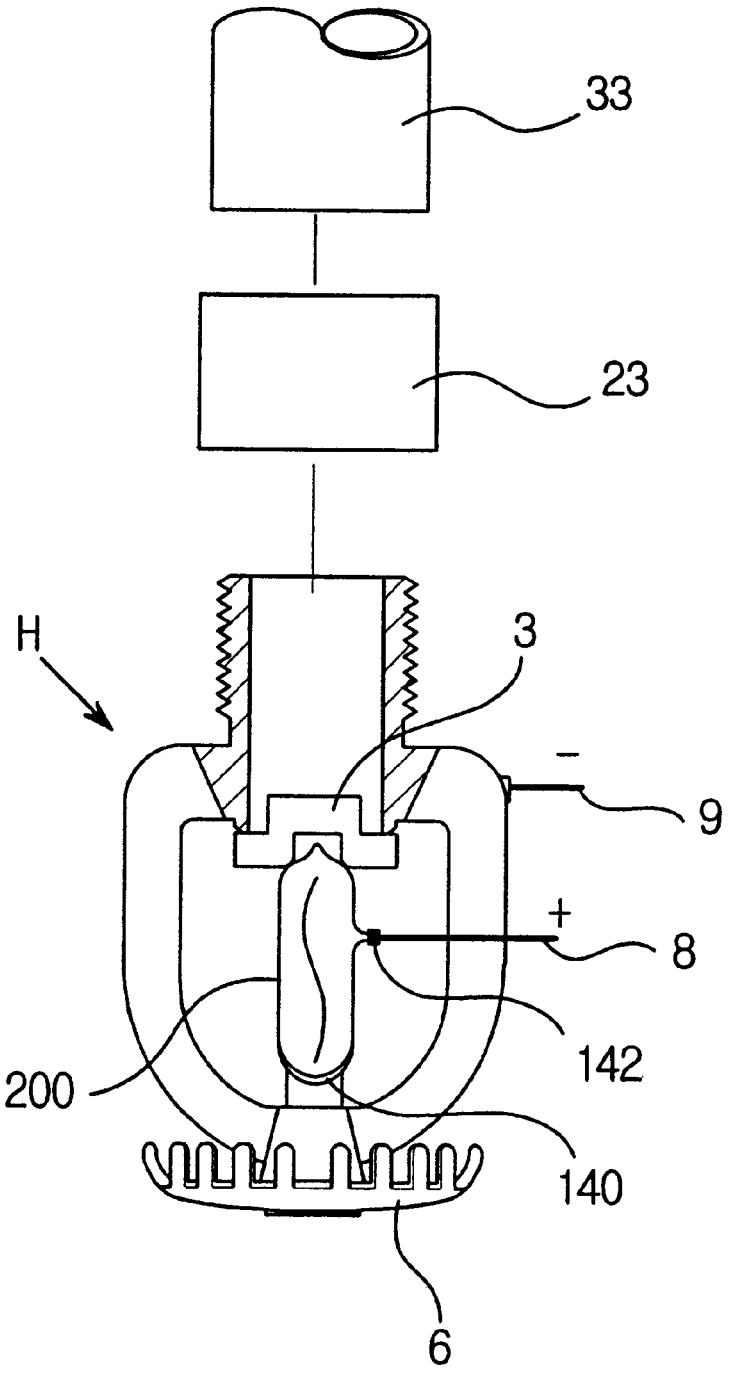
FIG. 15 is a sectional view of the sprinkler head which equips the thermal glass ampoule according to the present invention.

FIG. 11 is a schematic view showing a structure of a sprinkler which equips a glass ampoule according to the present invention, FIG. 12 is a partially broken sectional view of the ampoule according to the present invention, FIG. 13 is a plan view of the glass ampoule according to the present invention, FIG. 14 is a sectional view taken along the line 14—14 in FIG. 12 and FIG. 15 is a partially enlarged sectional view of sprinkler head which equips a glass ampoule according to the present invention. As shown in these drawings, the glass ampoule 200 for sprinkler according to the present invention is made from the conventional glass ampoule which has heat expansive gas inside thereof but has a new element of electric thermal coil installed inside thereof and, therefore, the glass ampoule 200 for sprinkler according to the present invention comprises a closed hollow cylindrical glass casing 100; an electrical heating coil 120 installed inside of said glass casing; a negative electrode 140 provided on outer surface at bottom end of said casing and electrically connected with one end of said coil; a positive electrode 142 provided on outer surface at side wall 102 of said casing and electrically connected with the other end of said coil; and heat expansive gas G entrapped inside the casing.

Figure 16:
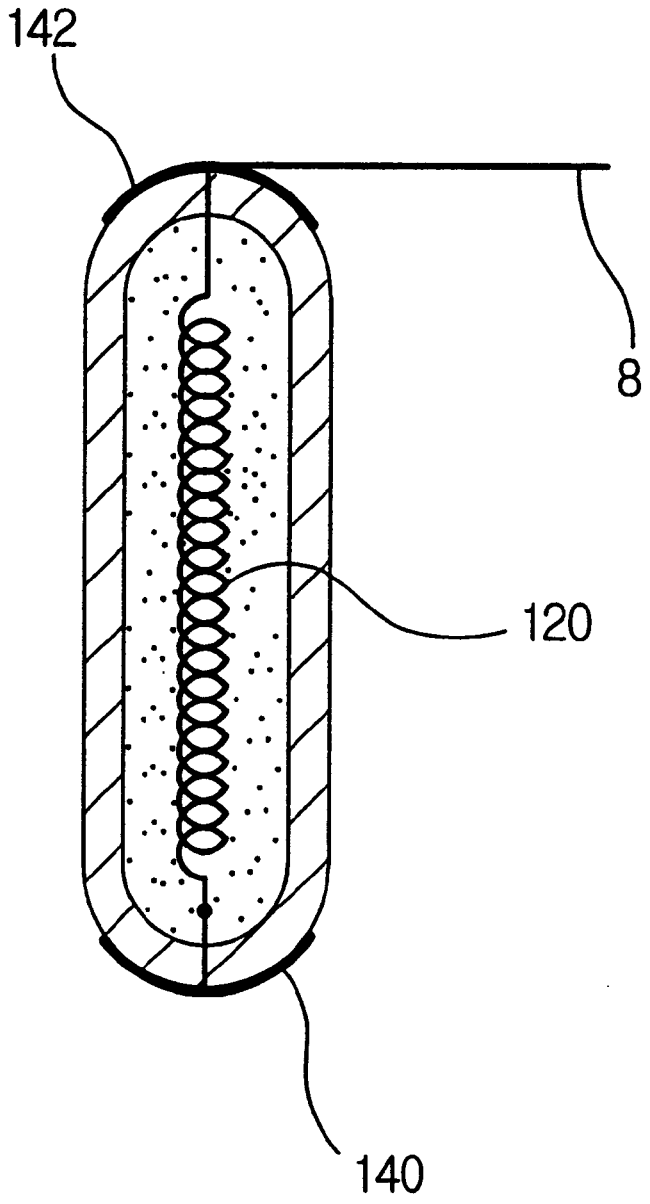
FIG. 16 is a sectional view of the thermal ampoule according to another embodiment of the present invention.

In the ampoule described above, two electrodes 140 and 142 are provided at the bottom end and at the side wall of said casing respectively. However, as shown in FIG. 16, the position where said electrodes 140 and 142 could be provided is chosen at the bottom and top ends of the casing respectively according to the shape of the glass casing and the coil and manufacturing process thereof.

Since the glass ampoule 200 according to the present invention can be manufactured as a single body integrated with a thermal coil inside of the casing, it has advantages in lights that it is possible to precisely make the ampoule with healthy operation and has good install handiness due to no necessity of coil being wound around the ampoule and has long term duration because the coil is installed inside the glass casing and, thus, can be prevented from corrosion. Further, the glass ampoule 200 according to the present invention has another advantage of much faster actuating response because the coil is heated inside the glass casing and, thus, can give heat directly to the gas G.

Figure 17:
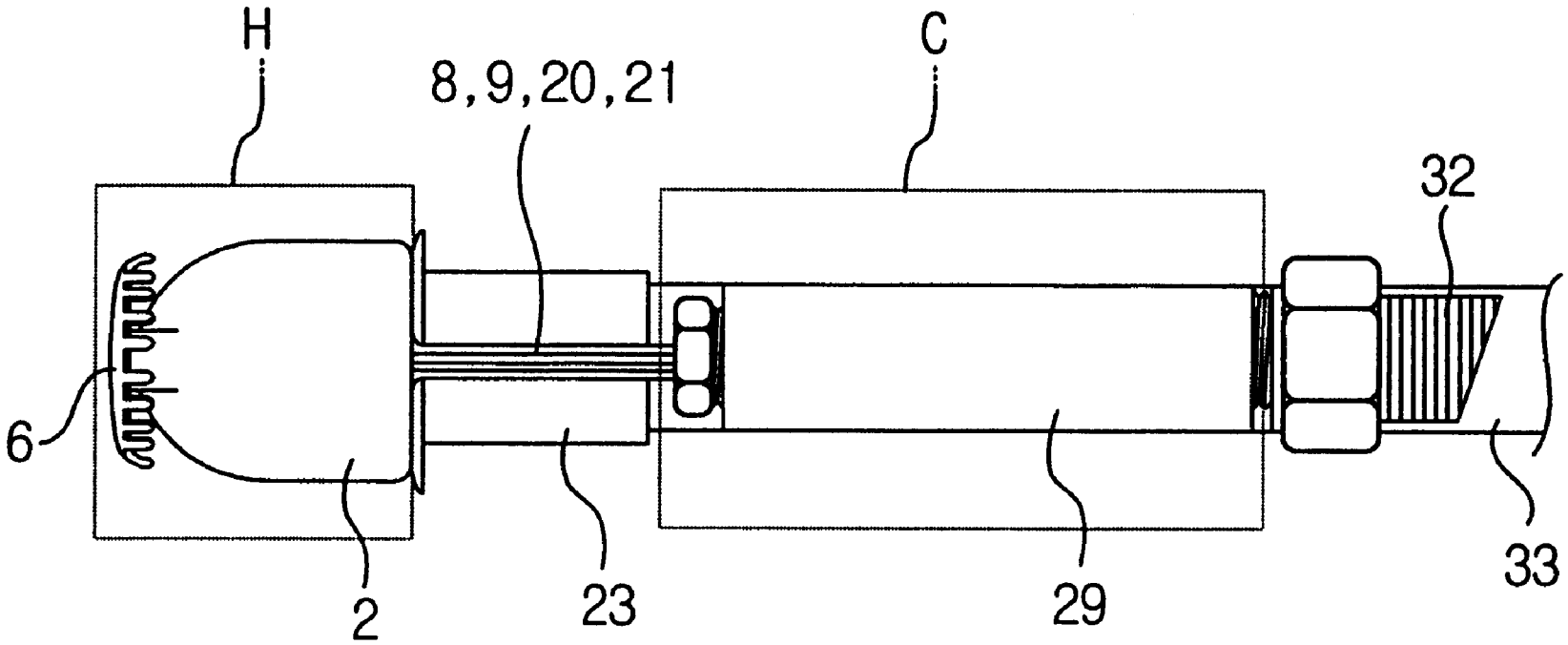
FIG. 17 is a schematic view of the sprinkler apparatus according to the present invention.
Figure 18:
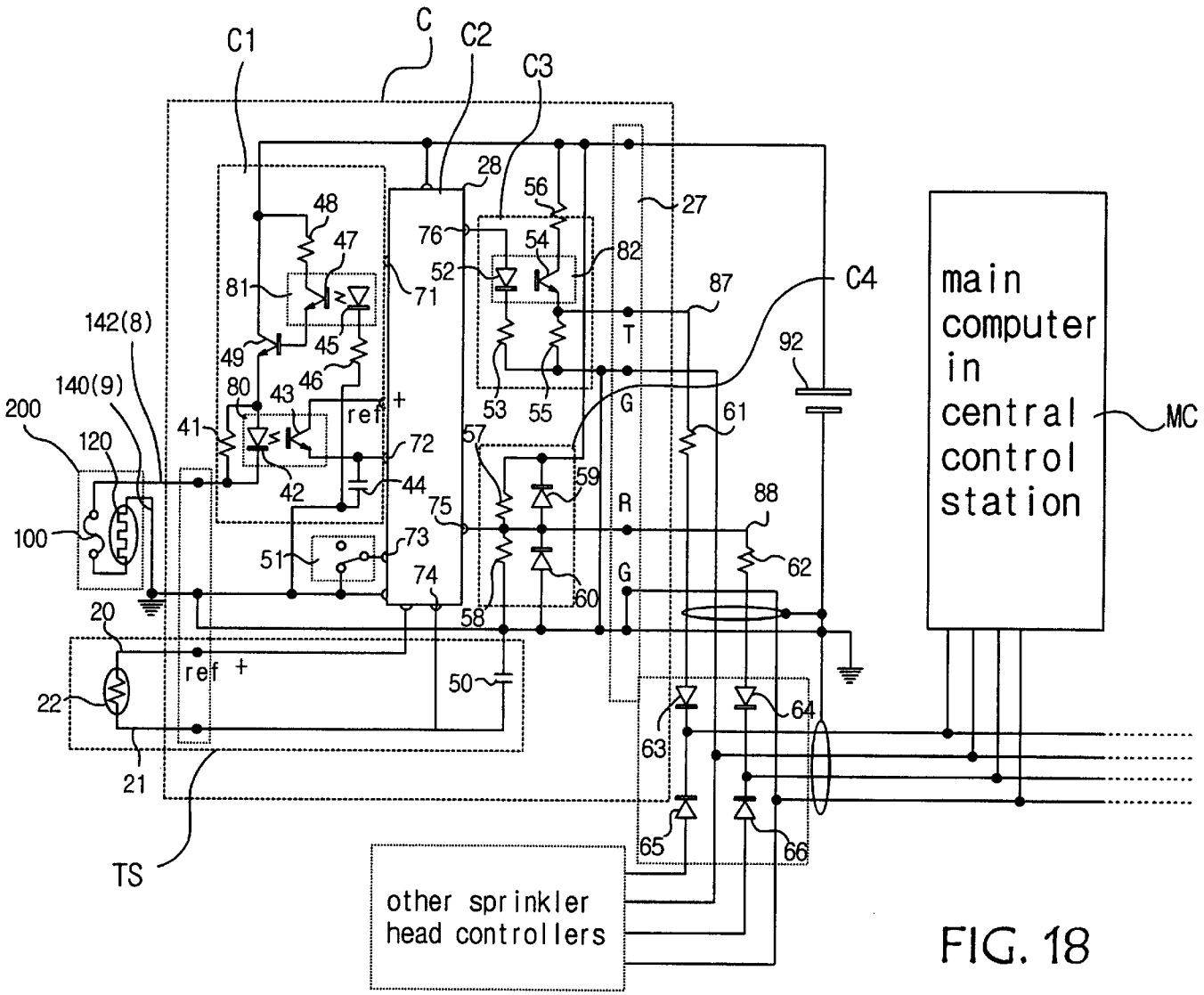
FIG. 18 is a circuit diagram of a sprinkler apparatus according to the present invention.

In FIGS. 17 and 18, the reference numeral 2 denotes the body of the sprinkler head H, 29 denotes the body of the sprinkler head controller C, 8 and 9 denote conductors for electrically connecting the sprinkler head H to the sprinkler head controller C, 20 and 21 denote conductors for electrically connecting a thermistor 22 to the sprinkler head controller C, and 32 denotes a wire duct containing power lines for applying electric power to the sprinkler head H and controller C and signal lines for transmitting and receiving signals to/from other equipment. Also, the reference numeral 33 denotes an extinguishing liquid supply pipe coupled with an extinguishing liquid storage tank (not shown), 23 denotes a pipe coupling socket for coupling the sprinkler head H with the extinguishing liquid supply pipe 33, and 36 denotes a fixing band for fixing the body 29 of the sprinkler head controller C to the extinguishing liquid supply pipe 33.

The sprinkler head H includes, as shown in FIG. 11, an extinguishing liquid discharging nozzle 1 coupled at the upper end of the body 2 with the extinguishing liquid supply pipe 33 via the pipe coupling socket 23, and an extinguishing liquid diffusing plate 6 fitted horizontally under and to the lower end of the body 2, and a negative electrode 9 attached on the outer surface of the body 2.

A valve plate 3 is so supported by a glass ampoule 200 as to close the extinguishing liquid discharging nozzle 1. Said body is made of any proper conductive material and is electrically grounded to keep uneven balance. Said glass ampoule is located between a connecting bolt 5, which fits the diffusing plate 6 to the body 2, and the valve plate 3.

FIG. 18 is a circuit diagram of a sprinkler apparatus in accordance with the preferred embodiment of the present invention. As shown in this drawing, the sprinkler apparatus comprises the thermal glass ampoule 200, a temperature sensing circuit TS, the sprinkler head controller C and a main computer MC in a central control station.

The temperature sensing circuit TS is installed in the sprinkler head H to readily sense high heat generated upon the occurrence of a fire in a building. To this end, the temperature sensing circuit TS includes the thermistor 22 having its resistance varying with the ambient temperature, and a temperature sensing capacitor 50.

The sprinkler head controller C includes a current supply/feedback circuit Cl for supplying a predetermined amount of rated current to the thermal glass ampoule 200 and detecting the amount of current fed from the coil of the ampoule back thereto, and a one-chip microcontroller C2 for controlling the current supply/feedback circuit Cl to supply the predetermined amount of rated current to the thermal glass ampoule 200. The microcontroller C2 is further adapted to analyze the amount of current detected by the current supply/feedback circuit Cl and discriminate the presence of a fault in the thermal glass ampoule 200 and an aged state thereof in accordance with the analyzed result. The sprinkler head controller C further includes a signal transmitter C3 for transmitting an output signal from the microcontroller C2 to the main computer MC in the central control station, a signal receiver C4 for receiving an output signal from the main computer MC and transferring it to the microcontroller C2, and a switch 51 for storing an identification number.

The current supply/feedback circuit Cl is provided with a control photocoupler 81, a switching transistor 49, a current sensing photocoupler 80, a current sensing capacitor 44 and a plurality of device protection resistors 46 and 48.

The signal transmitter C3 is provided with a photocoupler 82, a plurality of device protection resistors 53, 55 and 56 and a signal transmission line 87, and the signal receiver C4 is provided with a pair of voltage-division resistors 57 and 58, a pair of diodes 59 and 60 for preventing a signal overload and limiting a reverse voltage, and a signal reception line 88.

A plurality of bypassing diodes 63 and 65 or 64 and 66 are connected to each of the signal transmission line 87 and signal reception line 88 to prevent signal interferences with the other sprinkler head controllers connected in parallel to the same line. As a result, even though a specific sprinkler head controller is damaged, cut, short-circuited or broken down due to a fire, the other sprinkler head controllers will be maintained in operation without any interference from the specific sprinkler head controller.

Noticeably, provided that sprinkler head controllers in a large number of sprinklers comprise signal lines to the main computer MC in the central control station, respectively, the wire layout in the building will become complicated and the signal lines will be wasteful in number. In special consideration of this point, according to the present invention, the sprinkler head controllers are connected in parallel to the main computer MC in the central control station via signal lines of a two-phase/four-wire system as shown in FIG. 18. As a result, the wire layout can be simplified and the signal lines can significantly be reduced in number regardless of the number of sprinklers installed in the building.

For reference, the reference numerals 61 and 62 in FIG. 18, denote specific resistances of the signal transmission line 87 and signal reception line 88, respectively, and 92 denotes a direct current (DC) power source (for example, a battery) for supplying DC power to the sprinkler head controller C and temperature sensing circuit TS.

The main computer MC is installed in the central control station to remotely control a plurality of sprinkler head controllers C and remotely check states of respective sprinklers. Namely, the main computer MC receives information from the sprinkler head controllers C, such as self-diagnostic results, sensed temperature results and actuated states, and displays the received information on display means (for example, a monitor) contained therein. Further, the main controller MC gives an alarm to an operator in the case of danger. In this manner, the main computer MC informs the operator of states of respective sprinkler heads H and transmits a plurality of control commands to the sprinkler head controllers C according to key operations by the operator or an algorithm contained therein to instruct each of the sprinkler head controllers C to perform a self-diagnostic operation or to compulsorily actuate the associated sprinkler head H.

Now, a detailed description will be given of the operation of the sprinkler apparatus with the above-mentioned construction in accordance with the preferred embodiment of the present invention with reference to corresponding Figs. First, a self-diagnostic operation for testing whether or not the thermal glass ampoule 200 maintains a healthy condition will be mentioned in connection with the operation of the sprinkler head controller C.

In the self-diagnostic operation, the microcontroller C2 in the sprinkler head controller C applies a pulse width modulation (PWM) signal to a light emitting diode 45 in the control photocoupler 81 for a predetermined period of time. At this time, the PWM signal has a duty factor set to such a value that can supply such a small amount of current as to cause no physical variation in the coil 120 of the glass ampoule 200.

In response to the PWM signal from the microcontroller C2, a phototransistor 47 in the control photocoupler 81 and the switching transistor 49 are sequentially switched to supply a predetermined amount of rated test current to the coil 120. At this time, a voltage corresponding to the amount of current flowing to the coil 120 is generated across a resistor 41 connected in parallel to a light emitting diode 42 in the current sensing photocoupler 80, and the light emitting diode 42 thus generates light of an intensity corresponding to the voltage generated across the resistor 41. As a result, current of an amount corresponding to the intensity of light generated from the light emitting diode 42 flows between a collector and emitter of a phototransistor 43 in the current sensing photocoupler 80. Then, the current flowing between the collector and emitter of the phototransistor 43 is charged on the current sensing capacitor 44. At this time, the microcontroller C2 detects charging/discharging times of the capacitor 44 through its bidirectional input/output port 72, discriminates the amount of current flowing through the thermal ampoule 200 the basis of the detected charging/discharging times and diagnoses an endurance of the thermal coil 120 and the presence of a fault therein in accordance with the discriminated result. Then, the microcontroller C2 outputs a control signal based on the diagnosed result to the transmitting photocoupler 82 through its output port 76, thereby causing the photocoupler 82 to generate a pulse signal and transmit it to the main computer MC in the central control station. In other words, with the lapse of a lengthy period of time from the installation of the thermal glass ampoule 200, the coil 120 of the ampoule 200 or connection lines from the coil to the power source 92 may be cut or short-circuited due to corrosion or other factors, resulting in a variation in resistance on a current path of the line consisting of positive power line 8→positive electrode 142→coil 120→negative electrode 140→negative power line 9. In this case, the amount of current flowing through the coil 120 becomes different from the previous one, thereby causing the charging/discharging times of the capacitor 44 to become different from the previous ones. As a result, the microcontroller C2 can check the state of the ampoule 200 on the basis of the charging/discharging times of the capacitor 44.

Next, a description will be given of the operation of the sprinkler head controller C which senses the occurrence of a fire through the temperature sensing circuit TS and thus actuates the sprinkler head H.

The thermistor 22 in the temperature sensing circuit TS has its resistance varying with the ambient temperature, and charging/discharging times of the capacitor 50 vary with the resistance variation of the thermistor 22. Namely, a time constant based on a resistance R of the thermistor 22 and a capacitance C of the capacitor 50 vary. At this time, the microcontroller C2 in the sprinkler head controller C detects the charging/discharging times of the capacitor 50 through its bidirectional input/output port 74, senses the ambient temperature on the basis of the detected charging/discharging times and discriminates the occurrence of a fire in accordance with the sensed result. Then, the microcontroller C2 outputs a control signal based on the discriminated result to the transmitting photocoupler 82 through its output port 76, thereby causing the photocoupler 82 to generate a pulse signal and transmit it to the main computer MC in the central control station. In the case where the occurrence of a fire is discriminated, the microcontroller C2 applies a PWM signal to the light emitting diode 45 in the control photocoupler 81. At this time, the PWM signal has a duty factor set to such a value that can supply such a predetermined amount of rated current as to allow the heater 14 in the thermal fuse F to generate high heat sufficient to fuse the conductive element 13. In response to the PWM signal from the microcontroller C2, the phototransistor 47 in the control photocoupler 81 and the switching transistor 49 are sequentially switched to supply the predetermined amount of rated current to the coil 120 of the ampoule 200.

The current from the switching transistor 49 flows through the current path of the glass ampoule 200 consisting of positive power line 8→positive electrode 142→thermal coil 120→negative electrode 140→negative power line 9. At this time, the thermal coil 120 generates electric heat higher than a threshold value which can make the gas G break the glass casing 100 due to its expansion. As the gas G entrapped within the glass casing 100 expands due to its heating and, thus, breaking the glass casing 100, the valve plate 3 become to open the sprinkler nozzle 1. As a result, extinguishing liquid is supplied from the extinguishing liquid storage tank (not shown) to the discharging nozzle 1 through the supply pipe 33 and then discharged from the discharging nozzle 1. The extinguishing liquid discharged from the discharging nozzle 1 is reflected and diffused by the diffusing plate 6 and thus sprayed within the building. At the same time, the current path of the ampoule 200 consisting of positive power line 8→positive electrode 142→thermal coil 120→negative electrode 140→negative power line 9 is blocked, thereby allowing no current to flow to the coil 120.

Figure 19:
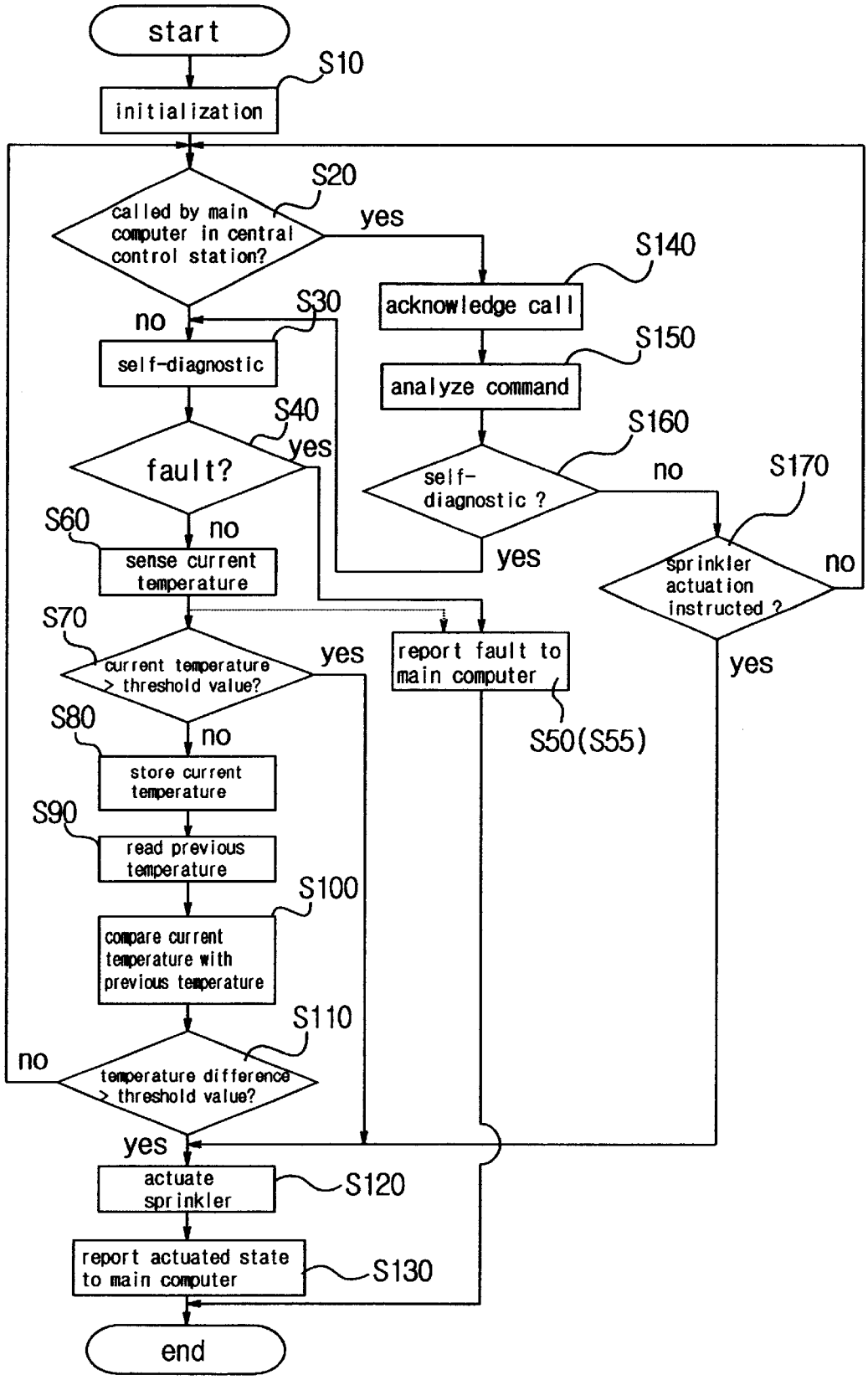
FIG. 19 is a flowchart illustrating a control operation of a sprinkler head controller which equips the thermal glass ampoule according to the present invention.

Next, a description will be given of a control operation of the sprinkler head controller C and the transfer of signals between the sprinkler head controller C and the main computer MC in the central control station with reference to a flowchart of FIG. 19. This description will be made centering around the sprinkler head controller C.

Figure 20:
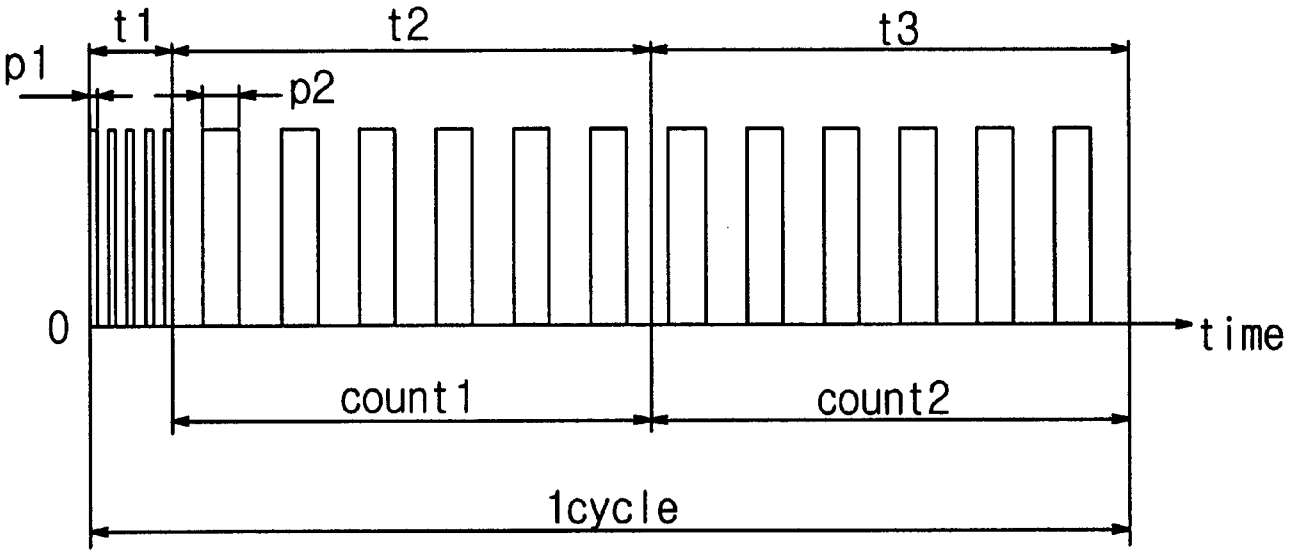
FIG. 20 is a waveform diagram of a synchronous signal used for the signal transfer between the sprinkler head controller which equips the thermal glass ampoule according to the present invention and main computer.

For reference, the sprinkler head controller C and the main computer MC in the central control station transmit and receive signals therebetween on the basis of a communication system which counts the number of synchronous pulses. As shown in FIG. 20, all data start with a synchronous signal in an interval t1 and is then converted into a pulse signal with a corresponding number of pulses. Subsequently, the pulse signal is transmitted while being divided into different intervals t2 and t3. Here, the synchronous signal has a pulse width P1 narrower than that P2 of the data signal (i.e., P1<P2) so that those signals can be identified by the sprinkler head controller C and the main computer MC in the central control station.

First, upon receiving the DC power from the DC power source 92, the sprinkler head controller C is initialized to wait for a command from the main computer MC in the central control station at step S10. Then, the sprinkler head controller C determines at step S20 whether it is called by the main computer MC in the central control station. If the sprinkler head controller C is not called by the main computer MC at step S20, then it performs a self-diagnostic operation for the coil 120 of glass ampoule 200 at step S30. At step S40, the sprinkler head controller C determines from the self-diagnostic result whether a fault is present in the coil 120. If it is determined at step S40 that the fault is present in the coil 120, then the sprinkler head controller C reports the fault presence to the main computer MC at step S50 and then ends the control operation.

In the case where it is determined at the above step S40 that no fault is present in the coil 120, the sprinkler head controller C senses a current temperature within a place where the related sprinkler is installed, through the temperature sensing circuit TS at step S60 and reports the sensed result to the main computer MC in the central control station at step S55. Then, the sprinkler head controller C determines at step S70 whether the sensed current temperature exceeds a predetermined threshold value (for example, about 70° C.). Upon determining at step S70 that the sensed current temperature exceeds the predetermined threshold value, the sprinkler head controller C recognizes that a fire has occurred and then proceeds to step S120 of actuating the sprinkler. At this step S120, the sprinkler head controller C actuates the sprinkler head H to spray extinguishing liquid.

On the other hand, in the case where it is determined at the above step S70 that the sensed current temperature does not exceed the predetermined threshold value, the sprinkler head controller C stores a value of the sensed current temperature in a memory contained therein at step S80. Thereafter, the sprinkler head controller C reads a previously stored temperature value from the memory at step S90 and calculates a difference between the read previous temperature value and the sensed current temperature value at step S100. Subsequently, the sprinkler head controller C compares the temperature difference calculated at the above step S100 with a predetermined threshold value (for example, about 30° C.) at step S110. If the calculated temperature difference is not greater than the predetermined threshold value as a result of the comparison, then the sprinkler head controller C returns to the above step S20.

In the case where it is determined at the above step S110 that the calculated temperature difference is greater than the predetermined threshold value, the sprinkler head controller C recognizes that a fire has occurred and then actuates the sprinkler head H to spray extinguishing liquid at step S120. Here, the reason for calculating the difference between the current temperature value and the previous temperature value and comparing the calculated temperature difference with the predetermined threshold value is that the sprinkler is allowed to be actuated when the ambient temperature abruptly varies (for example, up to a deviation of 30° C.) as well as when it reaches the predetermined threshold value (for example, 70° C.). That is, when the ambient temperature abruptly varies, the sprinkler head controller C regards such a situation as the occurrence of a fire (i.e., it estimates the fire occurrence at a low temperature) and thus actuates the sprinkler. Thereafter, at step S130, the sprinkler head controller C reports the main computer MC in the central control station that the sprinkler has been actuated and then ends the control operation.

On the other hand, upon being called by the main computer MC in the central control station at the above step S20, the sprinkler head controller C transmits an identification number stored by the switch 51 to the main computer MC to acknowledge the call at step S140. Here, the main computer MC in the central control station identifies the acknowledging sprinkler head controller C in response to the identification number therefrom and transmits a command to the acknowledging controller C. Upon receiving the command from the main computer MC in the central control station, the sprinkler head controller C analyzes the received command at step S150 to determine at step S160 whether the main computer MC has instructed to perform the self-diagnostic operation for the thermal coil 120. If it is determined at step S160 that the main computer MC has instructed to perform the self-diagnostic operation for the thermal coil 120, then the sprinkler head controller C proceeds to the above step S30 of performing the self-diagnostic operation. However, if it is determined at step S160 that the main computer MC has not instructed to perform the self-diagnostic operation for the thermal coil 120, then the sprinkler head controller C determines at step S170 whether the main computer MC has instructed to actuate the sprinkler. Upon determining at step S170 that the main computer MC has not instructed to actuate the sprinkler, the sprinkler head controller C returns to the above step S20. However, in the case where it is determined at step S170 that the main computer MC has instructed to actuate the sprinkler, the sprinkler head controller C proceeds to the above step S120 to actuate the sprinkler.

In the present sprinkler apparatus constructed and operated as mentioned above, a plurality of sprinkler head controllers are connected in parallel to the main computer MC in the central control station via communication lines so that they can be controlled in a centralized manner by the main computer MC. This construction allows the operator in the central control station to readily discover a sprinkler with a fault through the main computer MC. Further, upon receiving a report from a certain one of the sprinkler head controllers on the occurrence of a fire, the operator controls others installed in places adjacent to the reporting sprinkler head controller to actuate sprinklers in those places. Therefore, the present sprinkler apparatus can prevent the fire from being spread and thus effectively fight the fire.

Industrial Applicability

As apparent from the above description, according to the present invention, sprinkler head controllers provided in sprinklers installed in respective places sense temperatures through temperature sensing circuits and actuate the associated sprinklers in accordance with the sensed results, respectively, wherein the glass ampoule 200 can be precisely manufactured as a single body integrated with a thermal coil inside of the casing, have good install handiness due to no necessity of coil being wound around the ampoule and has long term duration because the coil is installed inside the glass casing and, thus can be prevented from corrosion. Further, the glass ampoule 200 according to the present invention has another advantage of much faster actuating response because the coil is heated inside the glass casing and, thus, can give heat directly to the gas.

What is claimed is:

1. A thermal ampoule for use in a sprinkler, comprising:

a closed hollow cylindrical glass casing;

an electrical heating coil installed in the inside of the glass casing;

a negative electrode provided on the outer surface at bottom end of the casing and electrically connected to one end of the coil;

a positive electrode provided on the outer surface of the side wall of the casing and electrically connected to the other end of the coil; and a heat expansive gas entrapped inside the casing.

2. A thermal ampoule for use in a sprinkler, comprising:

a hollow casing containing a heat expansive gas, the gas having a characteristic rate of expansion given heat, the casing comprising first and second closed end portions located opposite to each other, and a side wall portion formed between the first and second closed end portions; and an electrical coil located in the inside of the casing and conducting an applied current flow therethrough, wherein the electrical coil generates a selected amount of heat in proportion to the current, and the heat is transferred to the gas.

3. The thermal ampoule of claim 2, wherein the hollow casing is configured to break as a result of the expansion of the gas.

4. The thermal ampoule of claim 2, wherein the coil includes first and second terminals, the first terminal being configured to receive the applied current, the second terminal being configured to cause the current to flow through the coil.

5. The thermal ampoule of claim 4, further comprising:

first and second electrodes; and first and second electrical wires connecting the first and second terminals of the coil to the first and second electrodes, respectively;

wherein the first electrode is configured to transfer the applied current to the first terminal, and the second electrode is connected to the ground.

6. The thermal ampoule of claim 5, wherein the first electrode and the connection to the first terminal are located on the outside of the casing, and the first electrical wire passes through the hollow casing in order to connect the first terminal to the first electrode.

7. The thermal ampoule of claim 6, wherein the side wall portion includes a protruding portion, and the first electrode is located on the protruding portion and shaped in conformance with the shape of the protruding portion.

8. The thermal ampoule of claim 5, wherein the second electrode is located on the second closed end portion, and the second electrical wire passes through the hollow casing in order to connect the second terminal to the second electrode.

9. The thermal ampoule of claim 5, wherein the first electrode is located on the first closed end portion, and the second electrode is located on the second closed end portion.

10. The thermal ampoule of claim 2, wherein the casing is formed from a substantially glass material.

11. The thermal ampoule of claim 2, wherein the casing has a substantially cylindrical shape.

12. A thermal ampoule for use in a sprinkler, comprising:

a closed hollow casing enclosing a heat expansive gas, the gas being selected to expand according to a specific amount of applied heat; and an electrical coil located in the inside of the casing and conducting current therethrough, wherein the electrical coil generates first and second amounts of heat in proportion to first and second applied currents, respectively, and transfers the first and second amounts of heat to the gas.

13. The thermal ampoule of claim 12, wherein the first amount of heat is selected to allow the gas to expand and break the hollow casing.

14. The thermal ampoule of claim 12, wherein the second current is smaller than the first current, and the second amount of heat is selected so that the expanded gas does not break the hollow casing.

15. A sprinkler head for use in a sprinkler, comprising:

a housing defining a liquid supply hole, the hole adapted to supply an extinguishing liquid to the inside of the housing;

a thermal ampoule located in the housing and containing a heat expansive gas and an electrical coil therein, the gas being selected to expand according to a selected amount of applied heat, wherein the coil is configured to generate the selected amount of applied heat based on an input current and is configured to transfer the selected amount of applied heat to the gas;

a valve plate supported by the ampoule so as to keep the hole closed;

wherein the amount of applied heat is selected to allow the expanded gas to break the ampoule, and the valve plate is configured to open the hole in response to the breaking of the ampoule, thereby discharging the extinguishing liquid from the sprinkler head.

16. A method of operating a thermal ampoule for use in a sprinkler, the method comprising:

applying a current to an electrical coil located in the inside of the thermal ampoule, the ampoule containing an expansion gas surrounding the coil; and feeding the current through the electrical coil so as to generate heat and expand the gas.

17. The method of claim 16, wherein the amount of generated heat is selected to allow the gas to expand and break the thermal ampoule.

18. The method of claim 16, wherein the applying comprises providing the current from a first electrode located on the outside of the ampoule to a first terminal of the coil.

19. The method of claim 18, wherein the feeding comprises feeding the current from the first terminal to a second terminal of the coil, the second terminal being electrically connected to a second electrode located on the outside of the ampoule.

20. The method of claim 16, wherein the ampoule is formed from a substantially glass material.

21. The method of claim 16, wherein the ampoule has a substantially cylindrical shape.

* * * * *